US006622768B2

(12) United States Patent
You

(10) Patent No.: US 6,622,768 B2
(45) Date of Patent: Sep. 23, 2003

(54) CORRECTION TAPE ROLL DEVICE

(75) Inventor: Kwang Ho You, 103-1102 Hyundae Apartment, 1037 Mansu-dong, Namdong-Ku, Inchunshi (KR)

(73) Assignee: Kwang Ho You, Inchunshi (KR)

( * ) Notice: Subject to any disclaimer, the term of this patent is extended or adjusted under 35 U.S.C. 154(b) by 16 days.

(21) Appl. No.: 09/966,120

(22) Filed: Sep. 27, 2001

(65) Prior Publication Data

US 2003/0056906 A1 Mar. 27, 2003

(51) Int. Cl.[7] ..... B32B 31/00

(52) U.S. Cl. ..... 156/577; 156/579; 118/76; 118/257; 242/160.4; 242/171; 242/588.6

(58) Field of Search ..... 156/577, 579, 156/238, 523, 527, 540, 574; 118/76, 200, 257; 225/46; 242/160.2, 170, 171, 588, 588.2, 588.3, 588.6, 160.4

(56) References Cited

U.S. PATENT DOCUMENTS 4,259,880 A * 4/1981 Ueno ..... 74/594.2
5,490,898 A 2/1996 Koyama
5,792,263 A 8/1998 Koyama et al.
5,942,036 A * 8/1999 You ..... 118/257
6,394,235 B1 * 5/2002 Poertzgen et al. ..... 188/72.6

FOREIGN PATENT DOCUMENTS

JP 11070785 A * 3/1999 ..... B43L/19/00

* cited by examiner

*Primary Examiner*—Richard Crispino
*Assistant Examiner*—Cheryl N. Hawkins
(74) *Attorney, Agent, or Firm*—Anderson Kill & Olick, P.C.; Eugene Lieberstein; Michael N. Meller

(57) ABSTRACT

The present invention relates to a correction tape roll device to be used for correcting erroneous or omitted letters and the like wherein securing the lateral distance between shafts for at least a pair of rolls is unnecessary, so that the spatial availability can be increased and thus the size of the device can be reduced, as compared to the conventional device in which the corresponding distance was relative large and so the device became voluminous.

2 Claims, 6 Drawing Sheets

CORRECTION TAPE ROLL DEVICE

FIELD OF THE INVENTION

The present invention relates to a correction tape roll device and more particularly to a correction tape roll device which is able to correct an erroneous description by covering it with correction paste in dry form fallen off a coated tape through a pressing operation.

BACKGROUND OF THE INVENTION

Generally a correction tape roll device includes a case in a certain form with openings, at least a pair of rolls provided rotatably within the case, a coated tape wound around one of the rolls and a tape guide projecting outward through an opening for guiding the movement of the coated tape and for allowing the coated tape to be pressed on paper as required.

A conventional correction tape roll device is described by referring to FIG. 1 which shows the exploded perspective view of one example of a conventional correction tape roll device.

As seen in FIG. 1, the correction tape roll device 100 is equipped with a case 110, which is formed, at the front and rear ends, with openings 111 and 112 respectively. Further, the case 110 is formed with an engaging hole 113 at a position on the top side and formed with an observation hole 114 on one side surface so as to allow the examination of the used amount for the coated tape. Further, a clip 115 is also provided on a rear side surface to be fastened to a pocket or the like if required. The case 110 so constructed is intended to retain the coated tape 120 and various other accessaries within it in a protective manner and also to be easily dismantled when required.

The main body 130 shown below the case 110 in FIG. 1 is provided with a tape guide 131 to guide the movement of a coated tape 120. The tape guide 131 projecting lengthily forward is inserted in the case from the rear opening 112 to be protruded to the outside through the front opening 111 at the time of assembling. The tape guide 131 can also function to help the coated tape 120 to be pressed during a correction work. As such a tape guide 131, a quality material with excellent elasticity should be used. A jacket 132 is shown in front of the tape guide 131. This jacket 132 has an opening 133 through which the tape guide 131 can extend and also functions to prevent the coated tape 120 from straying aside by contacting the tape guide 131. The tape guide 131 is formed with a roll mounting section 134 at its rear end. An elastic arm 135 is provided at a site around the circumference of the roll mounting section substantially in circular form. The elastic arm 135 is designed to detachably mount the main body 130 on the case 110 and provided with an engagement jaw 136 to secure the main body 130 by engaging with the engagement hole 113.

On the opposite sides of the main body 130 or the roll mounting section 134 to be more exact, the first and second rolls 140 and 150 are provided rotatably. As shown in the drawing, the first roll 140 is formed, on its one side, with the first gear 160 which has the first[]shaft 162 for mounting the first roll 140. This first roll 140 is the part on which unused coated tape 120 is wound. In addition, the roll mounting section 134 is provided with the second shaft 172 on which the second roll 150 is fitted in rotatable manner on the opposite of the roll mounting section 134, wherein the second gear 170 is coupled to the other end of the second shaft 172. The second roll 150 is used to wind a blank tape 122 after correction service.

In other words, after the first shaft 162 is mounted with the first gear and first roll 160 and 140, and the second shaft 172 is mounted with the second gear and second roll 170 and 150, the coated tape 120 is placed on the end of the tape guide 131, the jacket 132 is fitted thereon and then the pre-assembly is inserted in the case 110 under the state of the elastic arm 135 of the main body 130 slightly pressed, so that the engagement jaw 136 may be, engaged with the engagement hole 113 in the case 100 to complete the assembly. In this state, the tip end of the tape guide 131 is protruded through the front opening 111 and thus the correction tape device 100 is ready for use. In the case of no use, the front tip 111 can be pulled forward as shown in two-dot-chain line in FIG. 1 to protect the coated tape 120 against the environmental interference.

The disadvantage with the conventional correction tape roll device is that the need for securing enough lateral distance between the first shaft 162 and second shaft 172 results in relative large body 130 and case 110. In addition, there is another disadvantage that the correction work is possible only in one direction.

SUMMARY OF THE INVENTION

The object of the invention is to provide a correction tape roll device wherein securing the lateral distance between shafts for at least a pair of rolls is unnecessary, so that the spatial availability can be increased and thus the size of the device can be reduced.

The above object is achieved according to an aspect of the invention by a correction tape roll device with a first and second rolls for winding a tape therearound, comprising: a case of a particular shape open at least one side through an opening having a predetermined size; a main body including a tape guide protruding from said opening, the tape guide being formed, at one side, integrally with a roll mounting section, the tape guide being bent to form a stepped section between the tape guide and the roll mounting section, said stepped section being formed with a through-opening; a first gear formed rotatably at one side of the roll mounting section, the first gear being connected to the first roll; a second gear formed rotatably at the other side of the roll mounting section, the second gear being connected to the second roll; and a power transmitting gear unit consisting of an upper and lower stage gears to transmit the rotation of said first gear to said second gear for causing the rotation of the second gear, the lower stage gear being engaged with the first gear and the upper stage gear being engaged with the second gear through said through-opening in said main body.

Preferably, said first and second gears are arranged coaxial to each other on opposite lateral sides of the roll mounting section.

DETAILED DESCRIPTION OF THE INVENTION

Figure 1:
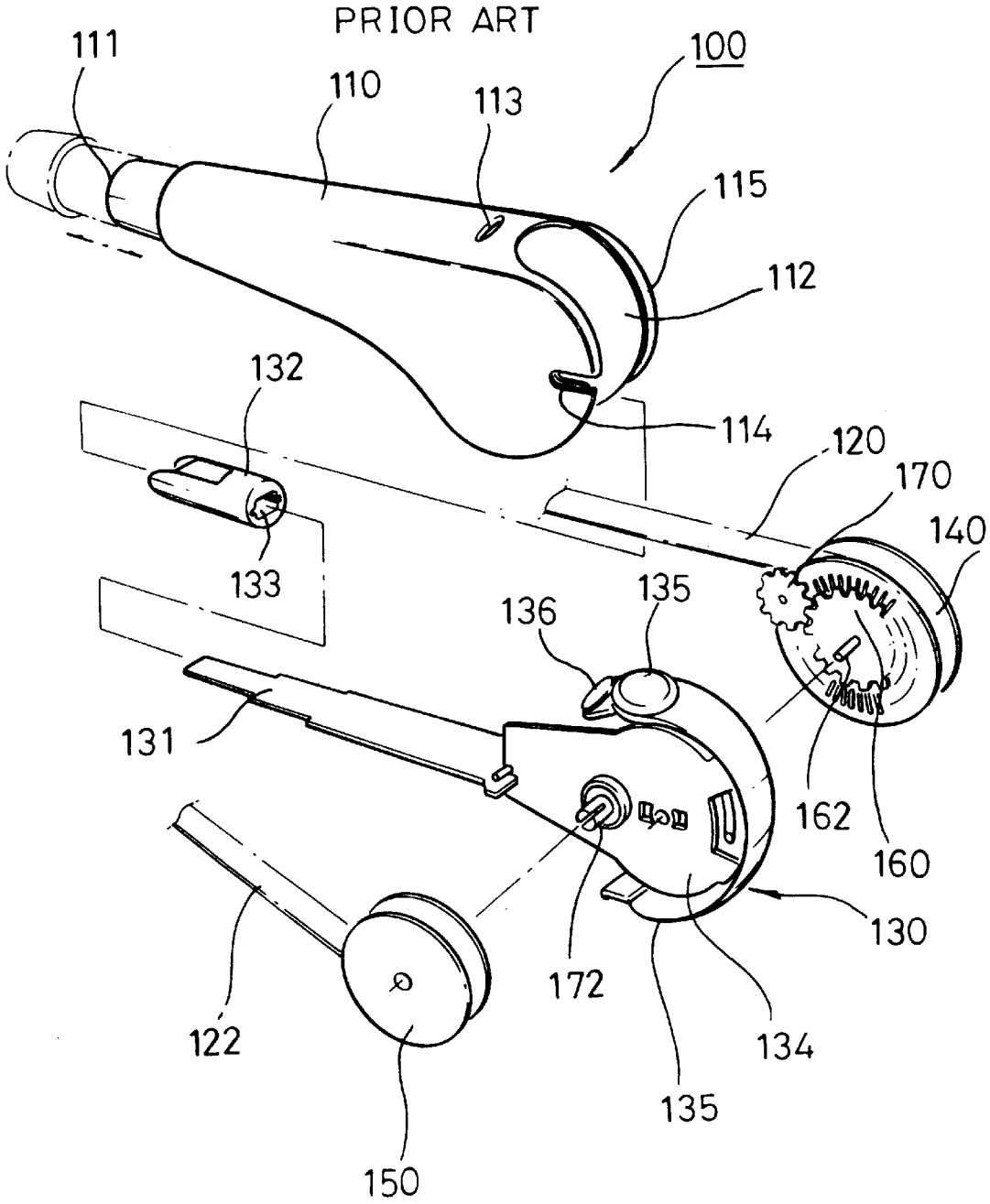
FIG. 1 PRIOR ART
FIG. 1 shows the exploded perspective view of an example of a correction tape roll device according to prior art.
Figure 2:
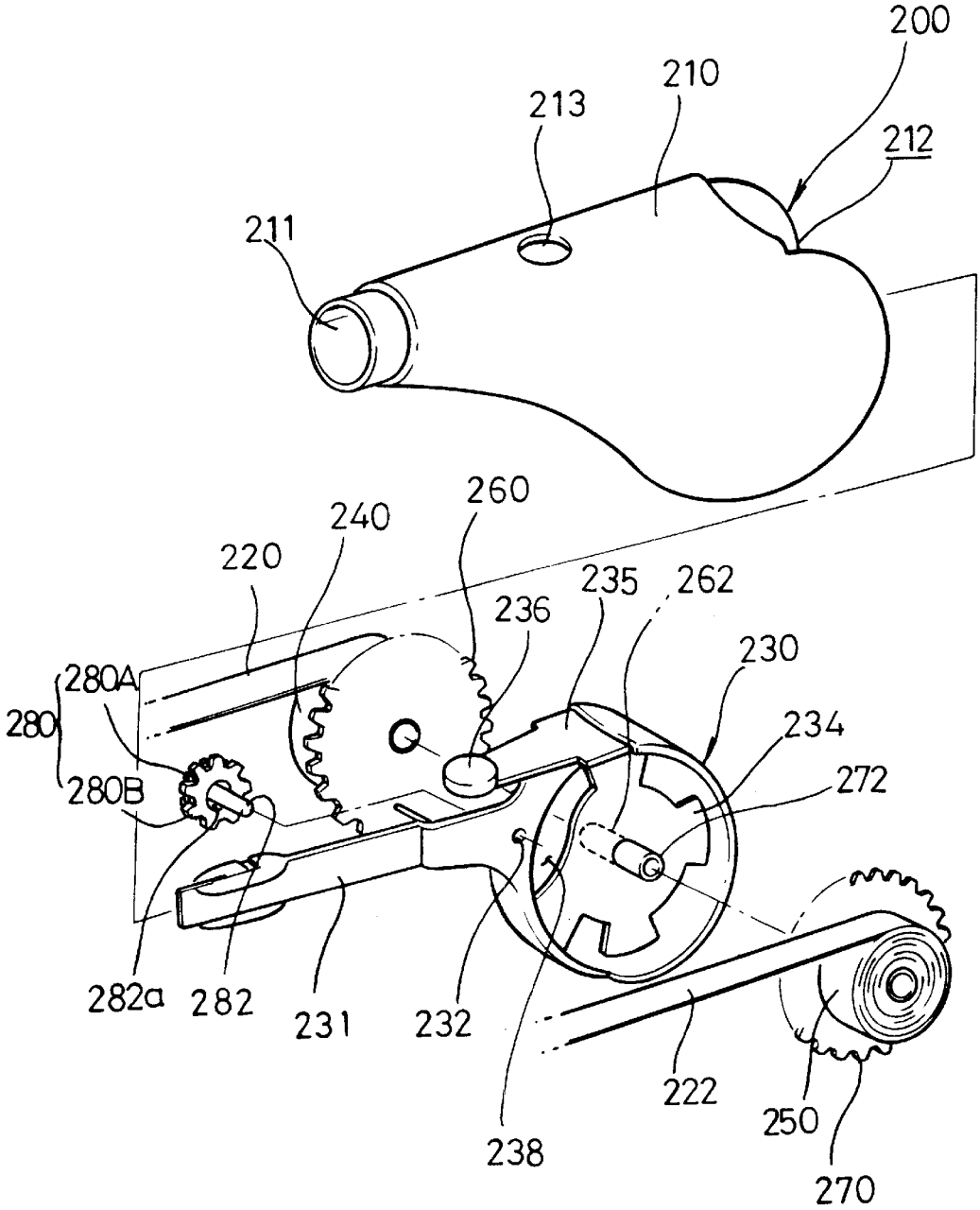
FIG. 2 shows the exploded perspective view of a correction tape roll device according to an embodiment of the invention.
Figure 3A:
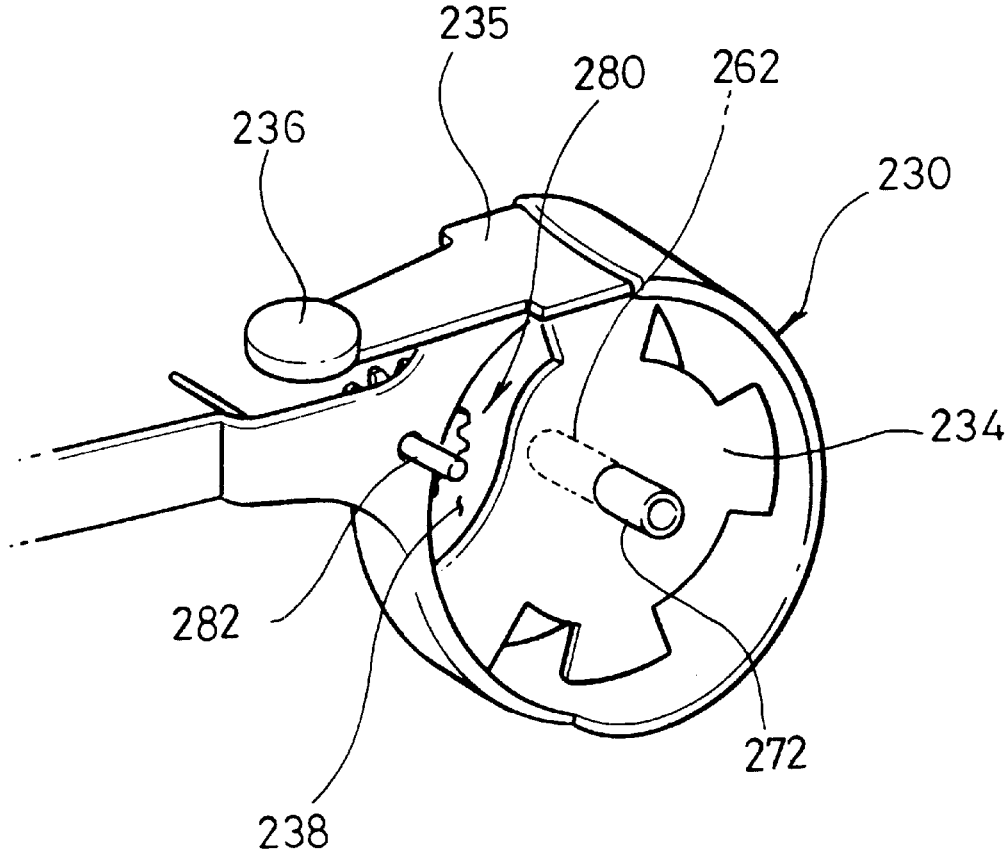
FIG. 3A shows the perspective partial view of a correction tape roll device according to an embodiment of the invention illustrating the manner of a power transmission gear unit mounted in the main body.
Figure 3B:
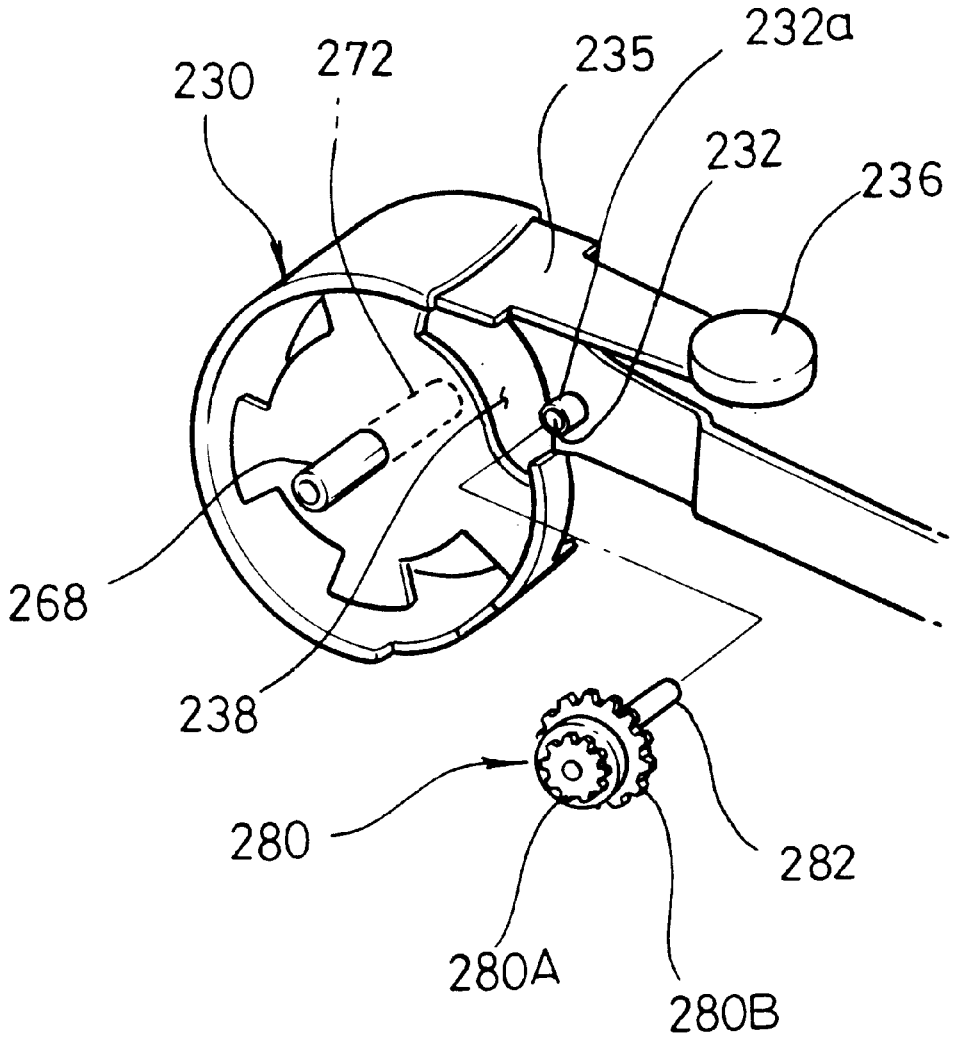
FIG. 3B shows the perspective view of FIG. 3A as viewed from the backside.
Figure 4A:
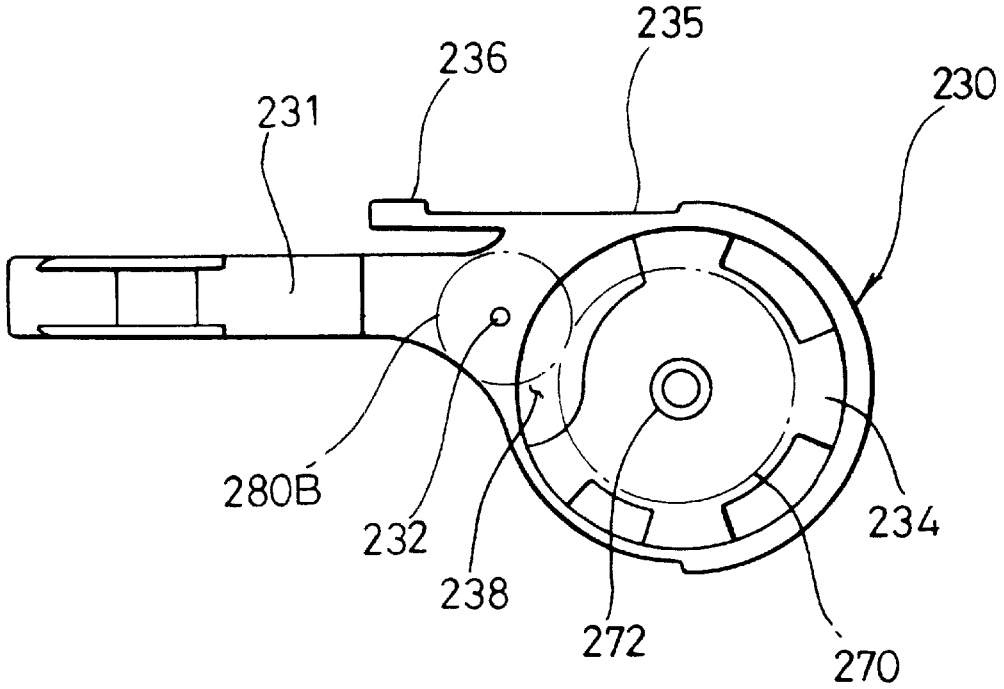
FIG. 4A shows the front view of the main body including the first and second roll as the main part of the correction tape roll device according to the invention.
Figure 4B:
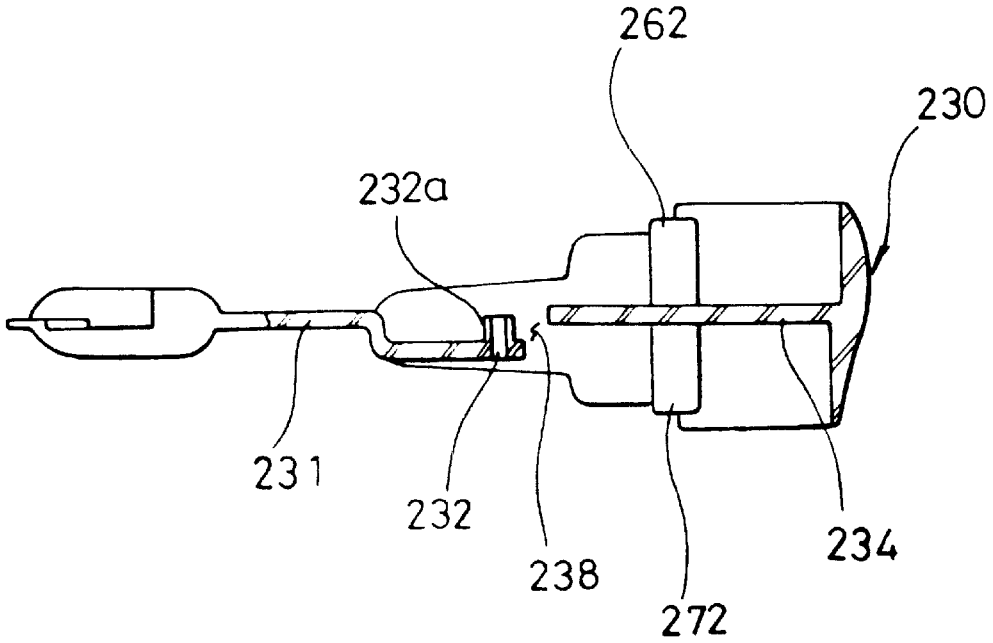
FIG. 4B shows the sectional plan view of the main body including the first and second roll as the main part of the correction tape roll device according to the invention.

A preferred embodiment of the invention will be described in detail below by referring to the accompanying drawings of FIGS. 2 through 5.

As shown, a correction tape roll device 200 according to the invention is provided with a case 210, and also formed with openings 211 and 212 at the front and rear ends, wherein the openings 211 and 212 are communicated with each other. The case 210 is formed likewise with an engagement hole 213 on its top side.

The correction tape roll device 200 according to the invention includes a main body 230 with a particular shape, which body is formed with a tape guide 231, wherein the tape guide can be inserted in the case 210 through the rear opening 212 to pass through the front opening 211 to thereby protrude forward with its front tip. On one side of the tape guide 231, a roll mounting section 234 substantially in circular form is formed integrally with the guide.

The tape guide 231 is bent to form a stepped section through which the tape guide 231 is connected integrally to the roll mounting section 234. At the stepped intersecting section between the tape guide 231 and the roll mounting section 234, there is formed a through-opening 238.

On the top side of the roll mounting section 234, there is formed an elastic arm 235 in the form of plate, which arm is intended to facilitate detachable mounting of the main body 210 in the case 230 and which is formed with a projection 236 on its top side end, so that this projection may be engaged with the engagement hole 213 to join the main body 230 with the case 210.

The roll mounting section 234 is formed on one side with the first shaft 262 and on the other side with the second shaft 272, wherein the first and second shafts 262 and 272 are aligned with and opposite to each other, whereby spatial efficiency is increased in comparison to the conventional shafts with a definite spacing between the two shaft axises. In other words, because the correction tape dispenser according to the invention need not secure the inter shaft distance due to coaxial arrangement while the securement of that distance was indispensable with the conventional device, the inventive correction dispenser device can accommodate more coated types compared to the conventional device having the same size as the present device.

Figure 5A:
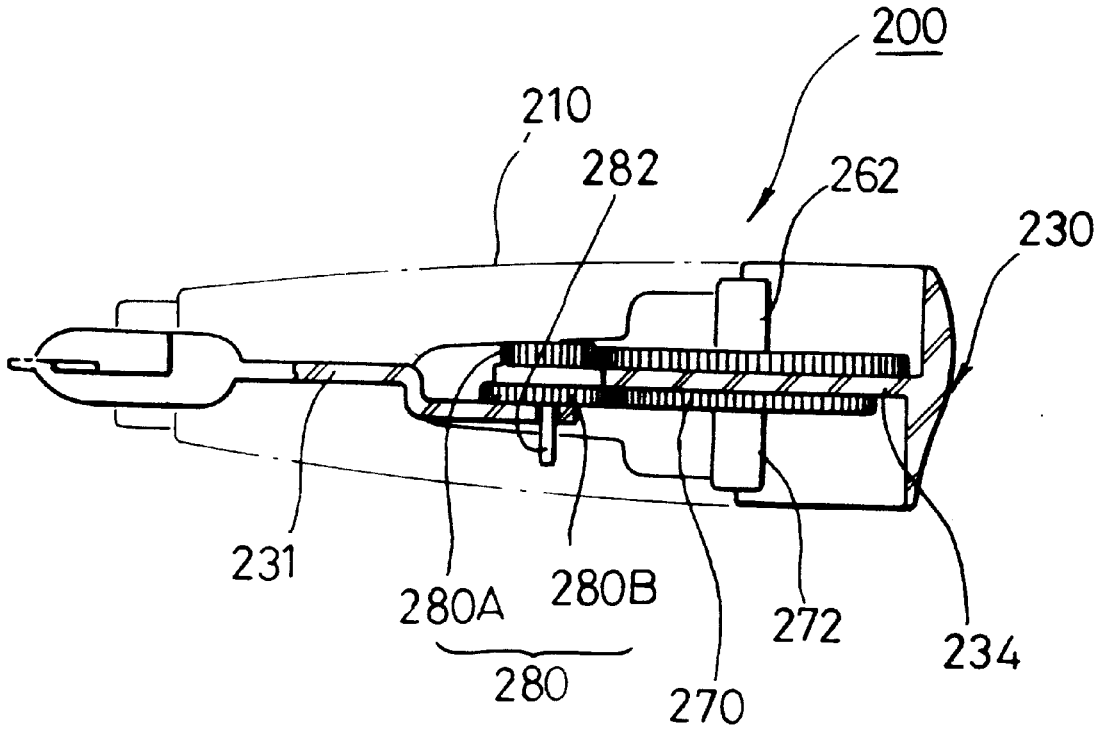
FIG. 5A shows the sectional plan view of the correction tape roll device according to the invention and FIG. 5B shows the cross sectional view of a significant part illustrating the coupling of the power transmission gear unit.

The inventive correction tape roll device 200 includes a first roll 240 for winding unused fresh coated tape 220 therearound and a second roll 250 for winding used tape 222. The first roll 240 is provided with a first gear 260 and the second roll 250 is provided with a second gear 270. The first and second rolls 240 and 250 are disposed on opposite sides of the roll mounting section 234, wherein the first arid second gears 260 and 270 are positioned so that the respective end parts of the gears 260 and 270 may lie in the through-opening 238 which is formed in the stepped intersection between the roll mounting section 234 of the main body 230 and the tape guide 231, particularly as shown in FIGS. 5A and 5B.

In addition, the second gear 270 is brought into rotation by a power transmission gear unit 280 through which the rotation of the first gear 260 is transmitted to the second gear 270. The transmission gear unit 280 is provided with a third shaft 282 rotatable in integration with the transmission gear unit 280, wherein the third shaft 282 guides the used tape 222 to be easily winded on the second roll 250. Further, the third shaft 282 is fitted in the hole 232 formed in the tape guide 231.

Figure 5B:
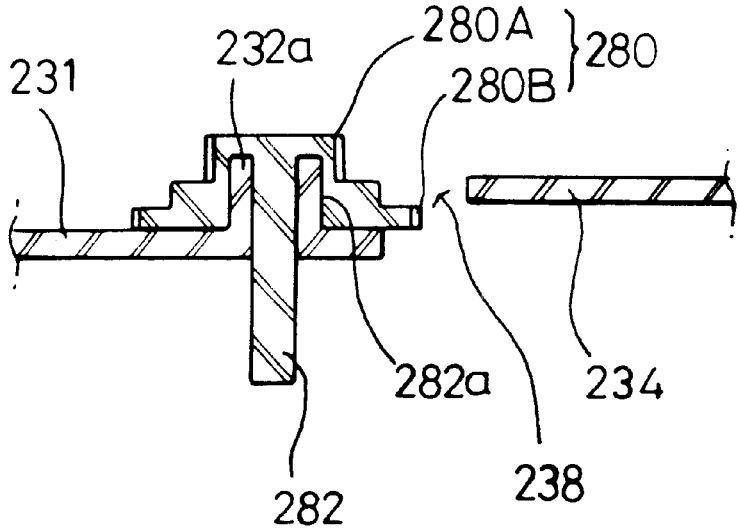

The circumferential area of the hole 232 is formed, on one side, with a projecting jaw 232*a* so as to be fitted in the groove 282*a* which is positioned around the third shaft 282 formed on the transmission gear unit 280, as can be seen in FIG. 5B. The fitted engagement of the projecting jaw 232*a* with the groove 282*a* assures the coupling of the power transmission gear unit 280.

The power transmitting gear unit 280 is composed of two stages, i.e. the lower stage gear 280A and the upper stage gear 280B, wherein the lower stage gear 280A is in engagement with the first gear, while the upper stage gear 280B is in engagement with the second gear 270. Accordingly, the rotation of the first gear 260 is transmitted to the second gear 270 to rotate the latter through the transmission gear unit 280 in engagement with the first gear 260.

In assembling, the main body 230, with the elastic arm 235 on the outside of the roll mounting section 234 lightly pressed, is pushed into the case 210 through its rear opening 212, so that the projection 236 on the elastic arm 235 may be engaged with the engagement opening 213 to result in the finished correction tape roll device 200 according to the invention. Now, the tape guide 231 is moved on the description to be corrected, with the tip of the tape guide pressed toward that description, so that the dry correction paste may be peeled off the tape for erase. As the case may be, the functions of the two rolls may be exchanged, such that the coated tape 220 is wound on the second roll 250 while the first roll 240 functions to wind up the used tape 222.

When a new coated tape 220 is desired to replace the used one, the main body 230 can be removed from the case 210 by pulling it backward while pressing the elastic arm 235. Then, the used roll(s) 240 and 250 can be replaced with new roll(s) having new coated tapes 220 wound thereon.

The correction tape dispenser i.e. correction tape roll device according to the invention need not secure the inter shaft distance due to coaxial arrangement while the securement of that distance was indispensable with the conventional device permitting the correction dispenser of the present invention to accommodate larger size coated tape.

In the correction tape roll device according to the invention, the spatial availability can be enhanced due to the unnecessity of securing the inter shaft distance, because the first and second gears 260 and 270 mounted with the first and second rolls 240 and 250 respectively are positioned coaxial to each other on opposite lateral sides of the roll mounting section 234 so as to be capable of transmitting the rotation through the power transmitting gear unit 280.

Moreover, the used tape 222 is so arranged as to be wound on the second roll 250 after it has been guided by the third shaft 282 rotating together with the power transmission gear unit 280 and therefore the possibility of making trouble in service, particularly the used tape being trapped, can be substantially eliminated.

What is claimed is:

1. A correction tape roll device with a first and second rolls for winding a tape therearound comprising:

a case of a particular shape open on at least one side through an opening having a predetermined size;

a main body including a tape guide protruding from said opening, the tape guide being formed, at one side integrally with a roll mounting section, the tape guide being bent to form a stepped section between the tape guide and the roll mounting section, said stepped section being formed with a through-opening;

a first gear formed rotatably at one side of the roll mounting section, the first gear being connected to the first roll;

a second gear formed rotatably at the other side of the roll mounting section, the second gear being connected to the second roll; and a power transmitting gear unit including upper and lower stage gears to transmit the rotation of said first gear to said second gear for causing the rotation of the second gear, the lower stage being engaged with the first gear and the upper stage gear being engaged with the second gear through said through-opening in said main body.

2. The correction tape roll device according to claim 1, wherein said first and second gears are arranged coaxial to each other on opposite lateral sides of the roll mounting section.

* * * * *